US005477769A

United States Patent [19]

Voigt, Jr.

[11] Patent Number: 5,477,769

[45] Date of Patent: Dec. 26, 1995

[54] PROCESS TO ENHANCE SAFETY OF CAST EXPLOSIVE COMPOSITE

[75] Inventor: H. William Voigt, Jr., Stanhope, N.J.

[73] Assignee: The United States of America as represented by the Secretary of the Army, Washington, D.C.

[21] Appl. No.: 322,669

[22] Filed: Oct. 13, 1994

Related U.S. Application Data

[60] Continuation-in-part of Ser. No. 962,090, Oct. 16, 1992, Pat. No. 5,358,587, which is a division of Ser. No. 724,075, Jul. 1, 1991, abandoned.

[51] Int. Cl.[6] ..... F42B 3/00

[52] U.S. Cl. ..... 86/20.12

[58] Field of Search ..... 86/20.12

[56] References Cited

U.S. PATENT DOCUMENTS 4,357,185 11/1982 Ringbloom ..... 149/11

4,425,170 1/1984 Jones ..... 149/11

4,699,741 10/1987 Back et al. ..... 149/11

5,358,587 10/1994 Voight, Jr. ..... 149/18

*Primary Examiner*—Peter A. Nelson

*Attorney, Agent, or Firm*—Anthony T. Lane; Edward Goldberg; John E. Callaghan

[57] ABSTRACT

A cast explosive composite of a nitramine which has been precoated, and TNT. The nitramine can be, for example, cyclotrimethylene trinitramine (RDX) or cyclotetramethylene tetranitramine (HMX). The precoating can be a TNT-insoluble wax or an anti-exuding material, such as one of cellulose acetate propionate and epoxy liquids. Methods for improving the safety of a cast explosive composite and for improving the relative reaction rate of such a composite are also shown.

1 Claim, No Drawings

PROCESS TO ENHANCE SAFETY OF CAST EXPLOSIVE COMPOSITE

This application is a continuation-in-part of U.S. patent application Ser. No. 07/962,090, filed Oct. 16, 1992, now U.S. Pat. No. 5,358,587 which is a divisional of U.S. patent application Ser. No. 07/724,075, filed Jul. 1, 1991, now abandoned. The disclosures of U.S. Ser. No. 07/962,090 and U.S. Ser. No. 07/724,075 are incorporated herein by reference.

The present invention relates to a process for enhancing the safety of a cast explosive composite and to such improved explosive composites. More particularly, the present invention relates to an improved composite explosive, such as one including trinitrotoluene (TNT) together with at least one other component, such as cyclotrimethylene trinitramine (RDX), which has been treated to improve its sensitivity to shock.

BACKGROUND OF THE INVENTION

Two crystalline nitramines are commonly stirred into the molten explosive, trinitrotoluene (TNT). These nitramines are RDX (cyclotrimethylene trinitramine) and HMX or Octogen (cyclo-tetramethylene tetranitramine). The most common of these composite, castable compositions is a 60:40 by weight RDX:TNT composition to which 1% by weight of the composite of an insoluble (in TNT) wax has been added. This composition is commonly known as "Composition B".

In conventional cast explosive composites, the RDX (or HMX) is unprotected, and the unprotected RDX (or HMX) crystals (about average of 160 micron size) suspended in the TNT matrix are responsible for the increase in premature gun explosions as compared to TNT loaded alone. Sensitivity to shock of the composite explosive is increased since, during melt-casting at temperatures to 100° C., some of the RDX (or HMX) dissolves in the TNT.

However, it is desired to retain the RDX (or HMX) in the TNT matrix since the detonation pressure of this composite cast is 293 Kbar vs. only 178 Kbar for a cast of TNT per se.

BRIEF SUMMARY OF THE INVENTION

An object of the present invention is to provide a cast explosive composite with a decreased risk of premature gun explosions and improved detonation pressure.

A second object of the present invention is to provide a method for improving the safety of cast explosive composites.

These objects and others, which will become clear to one skilled in the art may be accomplished by the present invention, which relates to a cast explosive composite, a method for improving the safety of a cast explosive composite and a method of improving the relative reaction rate of a cast explosive composite, as set forth below.

DETAILED DESCRIPTION OF THE INVENTION

This invention improves on the known process of protection of the RDX (or HMX) suspended in a TNT melt-cast matrix. For ease of illustration, further description will be directed to composites containing only RDX although it is to be expressly understood that such description is also applicable to composites including HMX. At present, the closed vessel or closed bomb, commonly used to evaluate propellant safety by burning propellant samples at increased pressures, is the test used to evaluate the RDX/TNT cast. See Velicky et al: *J of Energetic Materials*, Vol. 3, pp. 129–148 (1985), the disclosure of which is incorporated herein by reference. Such testing can also be conducted with respect to the present invention as well to confirm the superiority thereof.

Cast solid cylinders (2.54 cm in diameter) of Composition B (or a variation of Composition B) are supplied; the lengths are adjusted to produce a constant 32.00 gram mass. The sample is initiated with 3 grams of class 7 black powder. An electric match is used to ignite the black powder in turn. Each solid cylinder sample of cast explosive is burned in the same 178 cc closed vessel. The change in pressure over a change in time vs. the pressure is the area under the so-called "quickness" curve. This area represents the relative reaction rate. The relative reaction rate is presented by assigning the number 100 to standard Composition B.

It is desired, for safety, to reduce the relative reaction rate (to reduce the chance of gun in-bore premature explosions).

This invention is an improvement over the old process of stirring a TNT-insoluble wax into a RDX/TNT melt. In this conventional method, the wax (molten) migrates and partly attaches to the suspended RDX in the TNT melt. During solidification of the TNT, the wax migrates only in part to protect the RDX crystals. The "reaction rate" from the closed bomb burning of such a cast composite is assigned a relative reaction rate of 100. The standard Composition B exudes excessively at 71° C. within 3 to 6 days.

The present inventor has found a superior method, in which the TNT-insoluble wax is precoated onto the RDX, prior to mixing the RDX with TNT. The TNT-insoluble wax serves as an effective protectant, and the "relative reaction rate" was 42 (for better gun safety). That is, the inventor has produced a variation of Composition B (60:40 by weight RDX:TNT+1% wax) which has greater gun safety. The same amount of wax, when precoated on to the RDX, provides superior protection to the RDX, as compared to standard Composition B, where the wax is only stirred into the molten TNT and allowed to migrate. But exuding can still occur: 0.6–0.9% exuding 6 days at 71° C.

A yet superior process, of this invention, provides a variant of Composition B wherein (1) the closed bomb "reaction rate" is only 36. The coated RDX is stirred into the molten TNT, and then melt-cast. The material is cooled and broken into smaller pieces. The mode of action is for a portion of the coating to sacrificially blend into the TNT matrix to physically bind all exudation as soon as it occurs: Most of the coating remains on the RDX crystals as a protectant.

The anti-exudation coating comprises cellulose acetate propionate (CAP) and epoxy liquids. In one embodiment, the coating consists of about 50% CAP and about 50% epoxy liquids, uncured. The ratio of epoxy liquids is about 10 parts of Epon™ 828 epoxy resin (a product of the Shell Company) and about 40 parts of epoxidized oil plasticizer (Estynox™ 308 or Plastolein™ 9232). See U.S. Pat. No. 3,706,609, to Voigt, Jr. et al, the disclosure of which is incorporated herein by reference.

The process of coating RDX of about 160 microns with 1.67 wt % of the aforementioned plasticized cellulose acetate propionate (anti-exudation coating) is done to supply 60 parts by weight of RDX with 1 part by weight of coating (all suspended later in 40 parts by weight of TNT).

This invention will be better understood by reference to the following Examples.

Coating method (100 grams)

1) Dissolve 0.1 g polyvinylpyrrolidone (K90 grade) PVP in 35 mL of ethanol.
2) Add 10 mL of this solution to make 100 g of RDX damp.
3) Solution of CAP/epoxy liquids: Combine in 15 mL of ethanol, the following mixture:
   a) 0.825 g of cellulose acetate propionate powder (CAP-482-20);
   b) 0.014 g of Epon™ 828 liquid epoxy resin (bisphenol type) (uncured); and
   c) 0.695 g of Estynox™ 308 epoxy plasticizer (from castor oil); (total of 1.67 g added to the ethanol). Heat to 45°–50° C. to obtain a clear solution.
4) Stir in the solution of paragraph 3) to the ethanol-damp RDX. Continue heating to 45°–50° C. with stirring.
5) Dry in tray at room temperature overnight.
6) Final-dry on steam table to produce granular coated RDX.

While the invention has been described in conjunction with specific embodiments thereof, it is evident that many alternatives, modification and variations will be apparent to those skilled in the art in light of the foregoing description. Accordingly, it is intended to include all such alternatives, modifications and variations as set forth within the spirit and broad scope of the appended claims.

What is claimed:

1. A method for improving the relative reaction rate of a cast explosive composite comprising coating a nitramine with a protectant, mixing the coated nitramine with molten trinitrotoluene, and then affecting solidification of the composite by casting in a mold, the nitramine being selected from cyclotrimethylene trinitraamine (RDX) and cyclotetramethylene tetranitramine (HMX), the protectant being an anti-exuding material comprising 50% by weight of cellulose acetate propionate and 50 % by weight of uncured liquid epoxy resins.

* * * * *